US007584796B2

(12) United States Patent
Ayling

(10) Patent No.: US 7,584,796 B2
(45) Date of Patent: Sep. 8, 2009

(54) DRILLING RIG

(75) Inventor: Laurence John Ayling, Camberley (GB)

(73) Assignee: Coupler Developments Limited, Douglas (IM)

( * ) Notice: Subject to any disclaimer, the term of this patent is extended or adjusted under 35 U.S.C. 154(b) by 0 days.

(21) Appl. No.: 11/654,343

(22) Filed: Jan. 17, 2007

(65) Prior Publication Data

US 2007/0119622 A1 May 31, 2007

(51) Int. Cl.
*E21B 29/12* (2006.01)

(52) U.S. Cl. ..... 166/358; 166/380; 175/7; 414/22.68

(58) Field of Classification Search ..... 175/5–10; 166/358, 380; 414/22.51, 22.62, 22.66, 22.68
See application file for complete search history.

(56) References Cited

U.S. PATENT DOCUMENTS

| | | | | | |
|---|---|---|---|---|---|
| 2,781,185 | A * | 2/1957 | Robbins | 175/52 |
| 2,937,006 | A * | 5/1960 | Thayer | 175/6 |
| 2,972,388 | A * | 2/1961 | Thornburg | 175/52 |
| 3,491,842 | A * | 1/1970 | Castela et al. | 175/6 |
| 3,493,061 | A * | 2/1970 | Gyongyosi | 175/52 |
| 3,552,504 | A * | 1/1971 | Chappuis | 175/52 |
| 3,670,830 | A * | 6/1972 | Van Der Wijden | 175/52 |
| 3,741,320 | A * | 6/1973 | Hilfing | 175/6 |
| 3,977,480 | A * | 8/1976 | Hilding | 175/85 |
| 4,043,407 | A * | 8/1977 | Wilkins | 175/50 |
| 4,165,690 | A * | 8/1979 | Abrahams | 102/314 |
| 4,255,068 | A * | 3/1981 | Valantin | 405/195.1 |
| 4,348,920 | A * | 9/1982 | Boyadjieff | 81/57.25 |
| 5,174,389 | A * | 12/1992 | Hansen | 175/52 |
| 6,095,259 | A * | 8/2000 | Keyes | 175/20 |
| 6,138,774 | A * | 10/2000 | Bourgoyne et al. | 175/7 |
| 6,394,192 | B1 * | 5/2002 | Frazer | 175/58 |
| 6,397,955 | B1 * | 6/2002 | Cour | 175/52 |
| 6,457,526 | B1 * | 10/2002 | Dailey | 166/338 |
| 6,543,555 | B2 * | 4/2003 | Casagrande | 175/85 |
| 6,659,180 | B2 * | 12/2003 | Moss | 166/339 |
| 2001/0020550 | A1 * | 9/2001 | Casagrande | 175/52 |
| 2008/0093082 | A1 * | 4/2008 | Sheshtawy | 166/368 |

FOREIGN PATENT DOCUMENTS

| | | | |
|---|---|---|---|
| DE | 2056064 B | * | 2/1977 |
| WO | WO 2004018826 A1 | * | 3/2004 |
| WO | WO 2007004887 A1 | * | 1/2007 |
| WO | WO 2007129899 A1 | * | 11/2007 |
| WO | WO 2008100149 | * | 8/2008 |
| WO | WO 2008130242 | * | 10/2008 |

* cited by examiner

*Primary Examiner*—Thomas A Beach
(74) *Attorney, Agent, or Firm*—Ronald B. Sherer; Gerow D. Brill

(57) ABSTRACT

An underwater drilling rig (1) in modular form, which can be simply assembled underwater and in which standard tubulars and tubular assemblies are stored in a novel arrangement within containers (6) and can be added to, and removed from, the string in the well bore, whilst there is continuous circulation of drilling fluid and also continuous segregation of drilling fluid from the seawater.

8 Claims, 4 Drawing Sheets

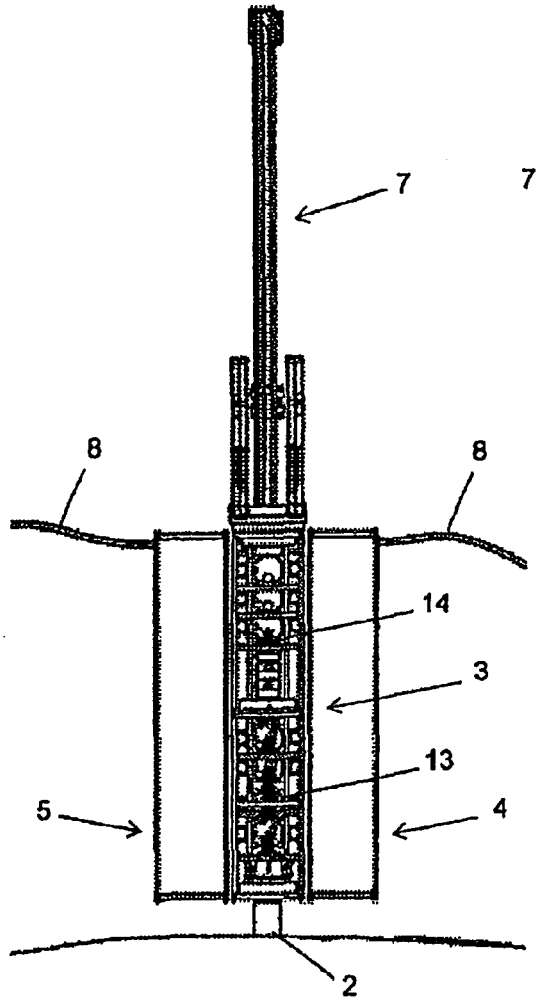
Fig.2 Front elevation
*with pipe unit 6A removed*
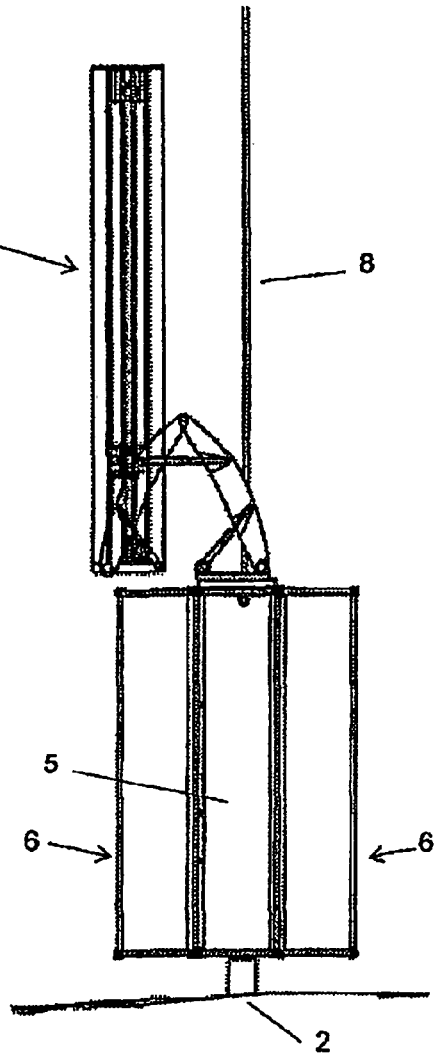
Fig.3 Side elevation
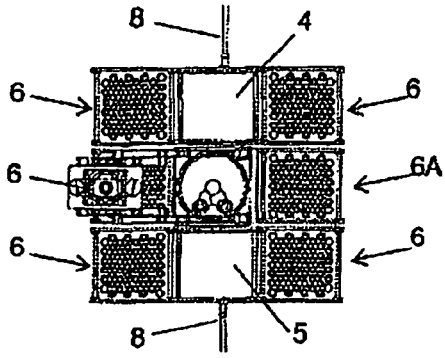
Fig.4 Plan view

DRILLING RIG

The present invention relates to a drilling rig that can be used underwater.

Drilling wells, including their completion and workover, is a well established practice on land; and also offshore, on platforms, jack-ups, barges, semi-submersibles and drill ships. Subsea, however, although there are some small seabed core sampling machines, drilling for hydrocarbons has not been carried out by a rig that is located totally underwater.

We have now devised an improved drilling rig which can be used underwater.

According to the invention there is provided a drilling rig which comprises (i) a stinger that can access stored tubulars and can convey mud into the string, (ii) a storage system for all tubulars and tubular assemblies, (iii) a drilling mast that carries the stinger and is able to move laterally between the well bore centre and the storage location of each tubular or tubular assembly in the storage system (iv) a continuous circulation coupler which is able to segregate the seawater from the drilling fluids and can make and break the tool joint connections, under pressure and (v) an assembly means which can launch and retrieve the rig from a rig support vessel and can assemble and disassemble the rig at the seabed.

Preferably the rig is in the form of a modular system to enable the seabed rig to be easily launched and retrieved from a rig support vessel and easily assembled and disassembled at the seabed.

In order to assemble and disassemble the rig and to operate the rig there can be remotely operated tools (ROTs), remotely operated vehicles (ROVs), ROT and ROV umbilicals and cables and autonomous underwater vehicles (AUVs).

The rig is assembled and controlled from a rig vessel which can include the drilling control centre, mud storage and pumps, pipe storage and handling, drilling power supply, heave compensated umbilical handling systems, 100 ton heave compensated cranes, gantry, ROT, ROV and AUV Davits etc.

Preferably there is an automated, programmed or remotely controlled handling device, such as the stinger, to locate, penetrate and grip a particular tubular or tubular assembly.

The stinger preferably provides internal support for a tubular to guide it and/or centralise it when entering a well bore, drilling equipment or storage location and the stinger can grip a tubular or tubular assembly from the inside, while another tubular, such as the top drive sub, is connected and torqued up.

Preferably the stinger resists the internal pressure of a well bore or drilling equipment, while a tubular is slid off the stinger into the said well bore or drilling equipment, thus greatly reducing the snubbing force that is typically required. This enables the top drive to snub a stand of pipe into a wellbore, or drilling equipment, without exceeding the limited maximum snubbing force available from a conventional top drive, or risking the buckling of the stand of pipe. A device for gripping the top of the pipe by a stinger is described in GB Patent Application 0207908.5.

The storage system preferably comprises containers for the tubulars and preferably there are one or more containers that serve to store most or all the tubulars and/or tubular assemblies such that each said tubular and/or tubular assembly is allocated a designated storage location. Preferably the containers accord with the International ISO standards such that the said containers may be transported as ISO containers by road, rail and sea. In use the containers are adapted to perform their function in the vertical or at any other angle in addition to their conventional horizontal orientation or aspect In a preferred embodiment the containers are adapted so that they can be connected to each other such that one container can support the weight of another full container, when both are parallel but not in the conventional substantially horizontal plane. For convenience the containers can be 10, 20 30 or 40 feet in length and also otherwise conform to standard ISO container specification.

The assembled rig on the seabed preferably comprises a wellhead module mounted on a foundation conductor which has been driven or drilled into the seabed. The wellhead module supports, laterally, a power module and a mud module and there are pipe modules which are also mounted adjacent to the wellhead module which can store tubulars and tubular assemblies.

The mast module can be attached directly on top of the wellhead module such that the stinger can be moved in and out of a tubular by a carriage or mechanism mounted on the mast. There is preferably a top drive mounted on the mast that is moved along the length of the mast by a carriage or mechanism mounted on the mast. Preferably both the stinger and top drive are mounted on the mast such that the mud supply is to the stinger and the top drive seals to the exterior surface of the stinger.

In use the mast can be moved laterally such that it can be made to line up with a tubular or tubular assembly that may or may not be on the centre line of the well bore.

The foundation conductor is driven into the seabed by a driving module, with a power module attached and extra lengths of conductor may be connected using the ROTs. Alternatively, the conductor may be jetted in or drilled in using the mast module with power module attached.

When the rig is assembled on the seabed and a tubular is to be added to the drill string, the mast moving means moves the mast over a tubular storage module and the stinger penetrates and grips the selected tubular. The top drive lowers and screws the top drive sub into the tubular, after which the stinger releases the tubular and the top drive withdraws the tubular onto the stinger. The mast is then moved over the drill string and the tubular connected using the continuous circulation coupler and drilling continued. To remove a tubular the process is reversed.

The rig can access a stored tubular or tubular assembly by penetrating it with the stinger, remove it from storage, move it laterally, line it up with a well bore, insert it into a well bore or drilling equipment, and drill with it, or connect it to a tubular string and then drill with it, or connect it to a tubular string and then release it to fetch another tubular or tubular assembly to add to the string. Optionally the rig can connect a tubular to a top drive or top drive sub before inserting it into the well bore or drilling equipment and can remove a tubular or tubular assembly from the well bore centre line and place it in storage before untorquing and unscrewing the tubular or tubular assembly from the top drive or top drive sub using a stinger to grip the pipe.

Preferably there is a submerged mud module that contains a choke or machine which can reduce the pressure of the fresh mud supply before it enters the drill string and/or a booster pump or machine that increases the pressure of the returning mud and cuttings before it returns to the rig vessel.

Preferably there is a submerged power module that provides electrical and/or hydraulic power to all other modules by transferring and transforming electrical power from the electric cable from the rig vessel.

There can be a submerged wellhead module that integrates the BOP stack, rotary BOP, slips and coupler into one unit.

The rig can be connected to the rig vessel by flexible umbilicals, or flexible risers, to transfer all of the necessary power, mud and instrumentation between the rig vessel and the seabed rig, to enable the seabed rig to drill full sized conventional wells for oil and gas without the need for rigid risers of any sort. Alternatively the rig can operate without any connection with a rig vessel at all, provided power is supplied by a submerged generator or a power pack that is regularly replaced, mud is reconditioned for re-use on the seabed, cuttings are containerised and regularly removed and the pipe modules and supply of fresh drilling fluids are regularly flown in by AUVs.

For convenience the rig can have any or all of its modules, conforming to the ISO standards for corners, dimensions or specifications.

The method of using a continuous circulation coupler is described in Patent Applications PCT/GB97/02815, PCT/GB99/03411 and PCT/GB01/04803. In one embodiment the method provides supplying mud, at the appropriate pressure in the immediate vicinity of the tubular connection that is about to be broken such that the flow of mud so provided overlaps with flow of mud from the top drive; as the tubular separates from the drill string the flow of mud to the separated tubular is stopped e.g. by the action of a blind ram or other preventer or other closing device such as a gate valve. The separated tubular can then be flushed out e.g. with air or water (if under water) depressured, withdrawn, disconnected from the top drive and removed. The action of the preventer is to divide the tubular connection into two parts e.g. by dividing the pressure chamber of the connector connecting the tubular to the drill string. The drill string continues to be circulated with mud at the required pressure.

Preferably there are means which seal off the circulating mud and other fluids to prevent environmental contamination whilst they are still circulating.

A tubular can be added using a clamping means which comprises a coupler and the top end of the drill string is enclosed in and gripped by the lower section of the coupler, in which coupler there is a blind preventer which separates the upper and lower sections of the coupler. The tubular is then added to the upper section of the coupler and is sealed by an annular preventer and the blind preventer is opened and the lower end of the tubular and upper end of the drill string joined together.

In use the lower section of the coupler below the blind preventer will already enclose the upper end of the drill stand before the tubular is lowered and when the tubular is lowered into the coupler the upper section of the coupler above the blind preventer will enclose the lower end of the tubular.

The tubular can be added to the drill string by attaching the lower section of the coupler to the top of the rotating drill string with the blind preventer in the closed position preventing escape of mud or drilling fluid. The tubular is lowered from substantially vertically above into the upper section of the coupler and the rotating tubular is then sealed in by a seal so that all the drilling fluid is contained. The blind preventer is then opened and the tubular and the drill stand brought into contact and joined together with the grips bringing the tubular and drill string to the correct torque.

The lower end of the tubular stand and the upper end of the drill string are separated by the blind preventer such that the tubular stand can be sealed in by an upper annular preventer so that when the blind preventer is opened there is substantially no escape of mud or drilling fluid and the tubular stand and drill string can then be brought together and made up to the required torque.

To remove another tubular from the drill string the tubular spool or saver sub under the top drive penetrates the upper part of the pressure chamber, is flushed out with mud and pressured up; the blind ram opens allowing the top drive to provide circulating mud and the spool and to connect to and to torque up the into the drill string. The pressure vessel can then be depressured, flushed with air (or water if under water) and the drill string raised until the next join is within the pressure chamber, the 'slips and grips' closed, the pressure chamber flushed with mud and pressured up and the cycle repeated.

Preferably the coupler includes rotating slips which support the drill string while the top drive is raised up to accept and connect another driver.

The making and breaking of joints can be carried out using conventional rotating slips or grips which can be outside the coupler but preferably are within the coupler.

The clamping means preferably comprises clamps which comprise substantially two semi-circular clamps which can be positioned at either side of a tubular and driven inwards, e.g. hydraulically until their ends meet and the tubular is firmly clamped and the tool joint or connection between the tubulars completely enclosed.

As the mud, drilling fluids or other circulating fluids can be kept segregated from the environment there is the capacity to reduce pollution and this is particularly advantageous as in the present invention where it reduces the risk of contamination of the sea-water, particularly with oil based muds which will not be able to enter the marine environment and no water can contaminate the mud or reach sensitive well bores.

To assemble the rig in 'soft' seabed conditions, the foundation conductor is spudded in by the driving module and is then driven into the seabed. The foundation casing can be held vertical, or at whatever angle is preferred, by the thrusters of a remotely operated tug (ROT) connected, for the purpose, to the top of the driving module. Additional lengths can be added to the foundation casing and piled, as is normal practice.

When the foundation casing has been installed, the driving module is removed and replaced by the mast module mounted on the base module. The mud and power modules, connected to the rig vessel by their umbilicals, are connected to the base module and a pipe module is also attached to the base module. The foundation casing is then drilled out with mud or water, returning the drill cuttings to the rig vessel if necessary.

The foundation casing may be further reinforced by installing an inner casing and cementing the annulus. This is particularly necessary when the laterally unsupported depth to firm consolidated sediment is considerable.

In 'hard' seabed conditions, such that drilling is required instead of 'driving', then the mast module, mounted on the base module, with mud, power and pipe modules attached can initiate the hole. For this purpose, the base module can be supported on the seabed by a gimballed base to hold its lateral location and to resist rotation. The whole drilling assembly can be held at the required angle by the thrusters of an ROT attached to the top of the mast module. If the base of the base module is unable to gain purchase on the seabed, then rotation of the seabed rig can be resisted by using the ROT thrusters to counter the torque of the mast module.

Once this hole is drilled, the mast module moves aside and the foundation casing can be inserted and secured either mechanically or by cementing, using the mud circulation circuit.

To install further casings, the seabed rig drills ahead, using standard drill pipe, returning all cuttings to the rig vessel and installs casing as normal. For this purpose though, the base module contains a range of slips to support and grip whatever string is hanging in the hole. All joints of drill string or casing are transported to the seabed rig in pipe modules and are accessed and extracted by the mast module.

With the 18¾" casing in place, the base module is replaced by the 18¾" diverter module, through which all further drilling for, and installation of, casings down to and including 13⅜" is carried out by the same seabed rig assembly.

With the 13⅜" BOP stack and coupler in place, all subsequent drill pipe, casing and tubing is run through the 13⅝" wellhead module.

Producing hydrocarbons to surface requires at least one of the two umbilicals to be rated at a differential of 5,000 psi, or, preferably, for a third special riser to be connected to transport produced fluids to a floating production vessel, while the well is still under control of the rig vessel.

For well drilling in very deep waters, well head pressures of up to 15,000 psi could be experienced on conventional floating rigs, if the mud in the annulus, or the drill pipe, became displaced by gas. However, with a seabed rig, the ability to shut in the well at the seabed, both at the inlet and outlet, improves this situation Additionally, the external pressure of some 10,000 psi in 20,000 ft of water, enables a 10 M rated system to withstand up to some 20,000 psi of internal pressure at that water depth, which could also be the total of the mud pump discharge pressure on the rig vessel plus the 20,000 ft head of heavily weighted mud.

The mud module receives fresh mud from the inlet mud header and passes return mud and drill cuttings to the outlet mud header. Both headers run through the mud module, diverter or stack modules, and power module, so that, either umbilical can be connected to either header. On board the rig vessel are standard mud pumps and standard cuttings retrieval and mud cleaning equipment.

At the seabed rig, within the mud module, the inlet mud can be choked to control the inlet pressure at the seabed. This allows the mud weight to be increased to achieve a high gradient over the exposed formation downhole, without raising the pressure at the bit. With increasing mud weight, however, the low pressure of the returning mud at seabed requires boosting to return it to the rig vessel. This can be done with one of the seabed pumps now being developed for Dual Gradient Drilling. Preferably, the 'choke' is a 'pressure let down' machine, reciprocating pump or turbine that can contribute power to the 'booster pump'.

The inlet mud is choked at the seabed to achieve the required inlet pressure and flow at the seabed. The booster pump is also controlled to achieve the required pressure and flow of the returning mud and cuttings in the annulus at the seabed. Both well head pressures and flows can be prescribed by a bore hole pressure model, which simulates the bore hole, real time, as the well is being drilled and allows the required downhole pressure at the bit to be achieved and maintained.

Inlet mud within the mud module is switched between the stinger in the drilling mast and the coupler, as the tool joint connections are made, to maintain continuous circulation. In all other respects the mud system is the same as on a conventional rig.

The power requirement on the seabed rig is similar to that of a conventional rig except that the mud pumps remain on the floating vessel. The typical power requirement for a 30,000 ft hole is 1,100 HP for Top Drive, 2,000 HP for Drawworks and 4,000 HP for the mud pumps. The typical power requirement for the seabed rig will be 1,100 HP for the top drive, 1,500 HP for the Drawworks and some 500 HP for the mud choking and boosting system, tubular handling, BOP Stack and coupler actuation, subsea connections, lighting and cameras, instrumentation and communications, totaling some 3,000 HP. The maximum operational combination is estimated to be of the order of 2,700 HP, or some 2 Mw. At a depth of 10,000 ft to 20,000 ft it is probably most economic to run the power down the umbilicals at 6.6 Kv, and transform down within the power module.

In the event of sudden loss of power from the rig vessel, the seabed rig will follow a pre-programmed sequence to shut in the well bore using a combination of stored energy, including hydraulic and/or battery power.

In addition to normal instrumentation, CCTV on ROTs, ROVs and the seabed rig will provide short range pictures and acoustic emitters/receivers will provide medium range pictures. Additional sensors will feed back information on the properties of the turning mud earlier than is possible in floating drilling rigs and tubular handling can be monitored continuously and recorded. All instrumentation and control signals will pass through both umbilicals to the RSV to provide security and back-to-back signal comparison.

In the event of sudden failure of both umbilicals, pre-programmed shut-in procedures will be initiated to maintain safety of the well and wellhead equipment until control can be re-established from the rig vessel. The power for this will come from the hydraulic accumulators and batteries within the power and mud modules.

Detailed real time computer modelling of the location, status and flight paths of all subsea modules, ROTs, ROVs, AUVs and their umbilicals, will facilitate simultaneous movements without incurring collision.

Most pipe modules will be of a mass of less than 50 to 75 tons. Those few pipe modules carrying heavy tubulars such as drill collars or extra heavy drill pipe or tubular assemblies may be part loaded to limit the total mass to 50 to 75 tons.

The mud module, containing the seabed chokes and booster pumps, the power module, containing transformers, switchgear and reserve power supply, the mast module, and the diverter module, containing an 18¾" BOP/Diverter, may all be limited to 50 to 75 tons.

The wellhead module, though, is likely to be considerably more than 75 tons but can be split into 2 or 3 sections of about 50 to 75 tons each The design could be:

- A 48" low pressure connector (to the foundation casing), plus a 13⅝"×10 M wellhead connector and three 13⅝"×10 M BOPs constituting the lower wellhead module;
- A 13⅝"×10 M connector, plus the returning mud header, plus 13⅝"×5 M RBOP, plus internal rotary slips, constituting the middle wellhead module;
- A 13⅝"×10 M coupler, plus the power transmission from the power module to the mast module, plus the inlet mud header, constituting the upper wellhead module.

This may enable all modules to be limited to less than 75 tons each

It is assumed that, in relatively shallow depths of 5,000 to 10,000 feet, it may be more economic to use heave compensated cranes on the rig vessel to lower and raise all modules, using the ROTs to attach the lifting cables, or, preferably, attaching the lifting cables to the ROTS, which themselves grip the modules, thereby not having to attach or detach lifting cables under water.

In deeper waters, of 10,000 to 20,000 feet, it may be preferable, in the course of time to use un-tethered ROTs, and buoyancy controlled modules, particularly when autonomous vehicles have been better established and more powerful batteries or other independent power sources have been developed.

The ROTs can attach to and guide all modules. The advantage of using the rig vessel's cranes for transportation is speed, in that the weight of the module can assist in the descent and crane power can assist in the ascent. This leaves the ROT's power to be used to compensate for sea currents and control the final positioning. The possibility of combining the lifting, power supply and control signals in a single ROT umbilical cable is possible, at least for moderate water depths.

In a preferred embodiment of the invention the rig comprises a central unit, mounted on the foundation conductor, which is either a base module, a diverter module or a wellhead module. The base module is used to drill for and install casing of 18¾" and larger and consists of:

A connector that latches onto the foundation conductor; a large annulus to contain and retrieve the returning mud and cuttings, which is piped to the mud headers; a means for piping fresh mud from the mud headers to the Drilling Mast; an internal rotary slips to support and grip a short drill string and the casing strings; power drives from the power module to the mast module; and instrument, electrical and hydraulic connections between all peripheral modules.

Once the 18¾" casing is installed, the base module is replaced by the diverter module, which is the same as the base module but contains an 18¾" BOP stack or diverter, to contain and control shallow gas or water.

Once the 13⅜" casing is installed, the diverter module is replaced by the wellhead module, which contains:

A connector that latches onto the foundation conductor, a BOP stack that connects with the 13⅝" casing head; a pipe manifold conveying returning mud from the annular off-take to the mud headers; a rotary BOP; an internal rotary slips to support and grip the drill string and casing strings; a Continuous Circulation Coupler; a pipe manifold conveying fresh mud supply from the mud headers to the drilling mast module and to the Continuous Circulation Coupler; power drives from the power module to the drilling mast; and instrument, electrical and hydraulic connections between all peripheral modules.

The drilling mast module includes:

A stinger that grips the inside of each tubular; drives to the stinger for axial motion and gripping; a travelling carriage on which the stinger is mounted; a modified top drive; drives to the top drive for axial and rotary motion; a travelling carriage on which the top drive is mounted; mechanical drive; mud supply, instrument, electrical and hydraulic connections to the module beneath, which may be the base, diverter or wellhead module.

It is a feature of the invention that the whole assembly can be mobilised in modules weighing less than 75 tons from a floating vessel and be assembled, in a water depth of up to 20,000 feet or more, into a Seabed Drilling Rig capable of drilling a full sized conventional oil well from the seabed.

The invention is illustrated in the drawings in which

FIG. 2 shows a front elevation of the rig

FIG. 3 shows a side elevation of the rig

FIG. 4 shows a plan view of the rig

Figure 1:
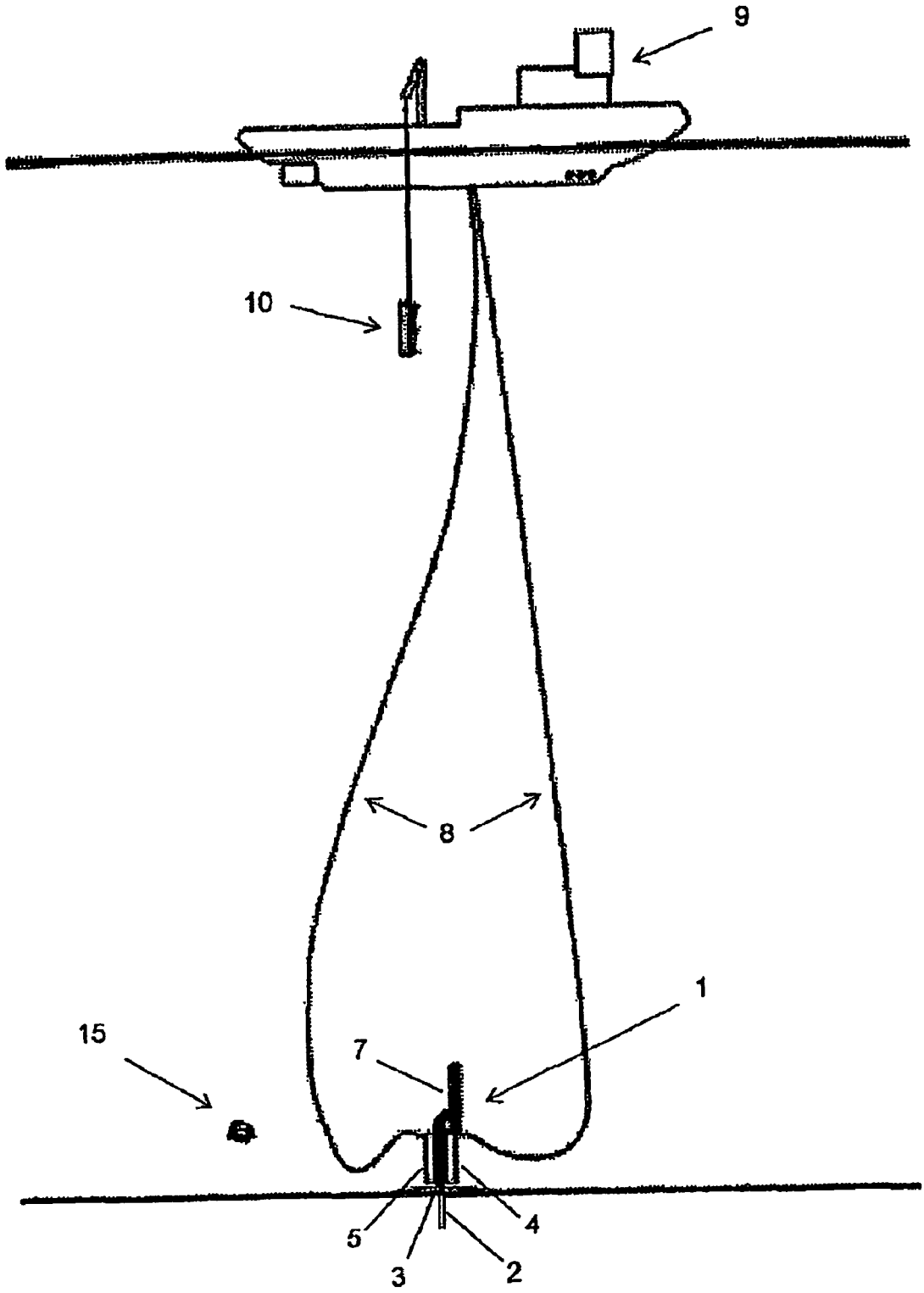
FIG. 1 shows underwater drilling using the invention

Referring to FIG. 1 the modules forming the seabed rig are transported from the rig vessel (9) to the seabed rig (1) by remotely operated tools (10) and monitored by autonomous underwater vehicles (15). The rig vessel (9) is connected to the seabed rig (1) via two or more umbilicals (8) to the power module (4) and mud module (5) (FIG. 2).

The two umbilicals (8) shown can transport either mud or mud and cuttings, or any other drilling fluid, to or from the seabed rig (1) and both carry electric power, control and instrumentation signals. In the event that the combination of mud and power in the same umbilical requires an umbilical of such a diameter that it is impractical to coil it onto a reel, then power and mud, plus other services, may require separate umbilicals, thus increasing the number of umbilicals to three or four.

Referring to FIGS. 2, 3 and 4 which show the rig in position when drilling normally and FIG. 2 is a view with module 6*a* of FIG. 4 removed, a wellhead module (3) is mounted directly on a foundation conductor (2) and a power module (4) and mud module (5) connect directly to the wellhead module (3) and up to six pipe modules (6) are each connected to the adjacent stack module, power module or mud module, three on one side (6) and three on the other side (FIG. 4). The pipe modules hold the tubulars to be added to a drill string during continuous drilling or to store tubulars when tubulars are removed from the drill string.

There is mast module (7) mounted on the top of the wellhead module (3) but can extend laterally to access any tubular, or tubular assembly, stored within any of the pipe modules (6).

Figure 5:
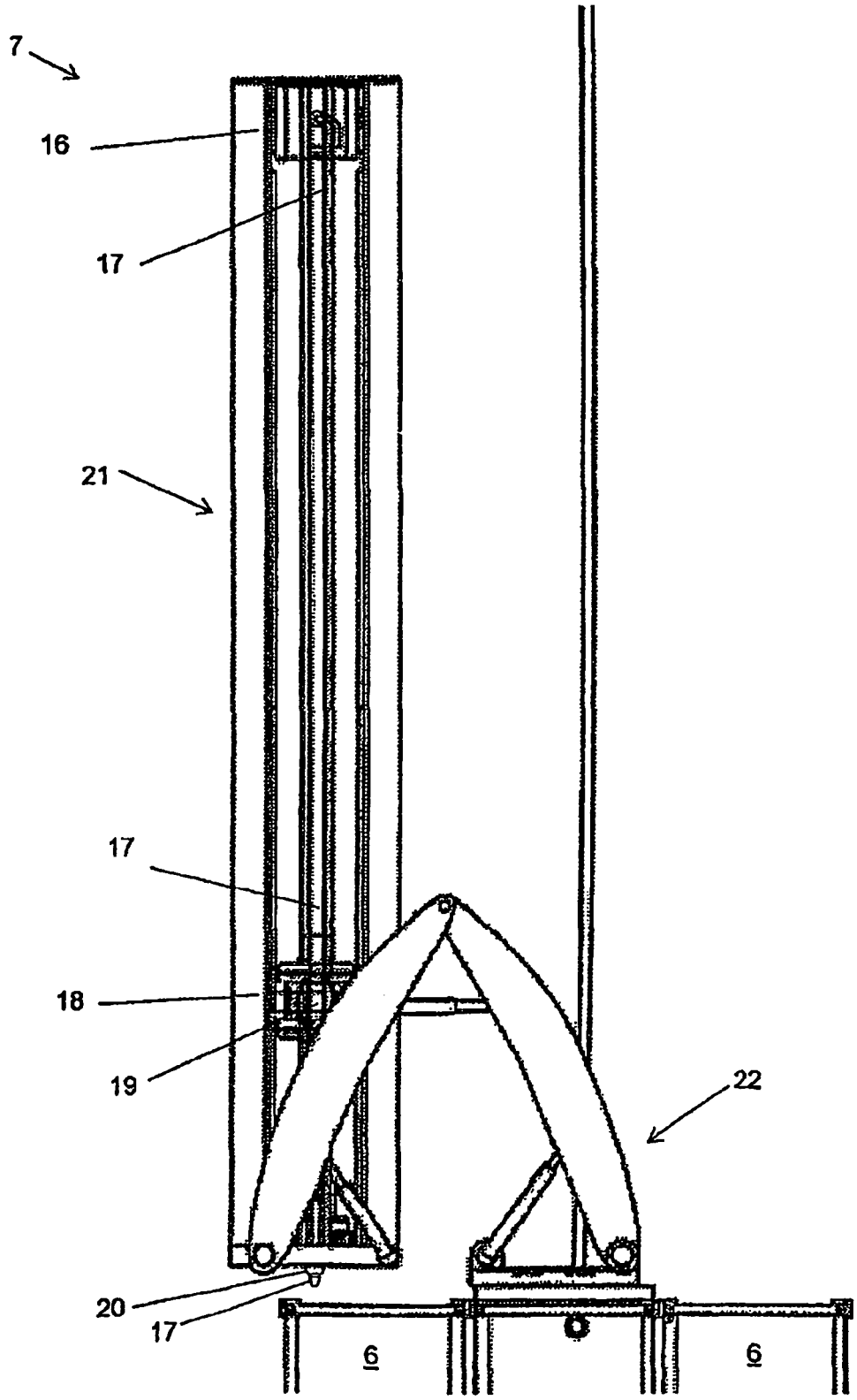
FIG. 5 shows a detailed view of the mast moving means.

Referring to FIG. 5 the mast (7) comprises a structure consisting of two torsion tubes (21) between which travel the two carriages (16) and (18) on which are mounted the stinger (17) and top drive (19) respectively. Beneath the top drive (19) is the top drive sub (20). The top drive (19) and the top drive sub (20) encircle and slide on the outer surface of the stinger (17). The top drive (19) seals against the outer surface of the stinger (17). Preferably, the top drive (19) includes a rotary seal between the top drive (19) and rotating sub (20) and an axial seal between the top drive (19) and the stinger (17).

In FIG. 5 the mast module (7) is shown displaced laterally from the centre line of the well bore by the hydraulic mechanism (22) in order to access a tubular in the far side of a pipe module (6). To access the tubular, the stinger (17) and stinger carriage (16) will move downwards by some 6 feet to penetrate and grip the selected tubular from the inside. Then the top drive (19) and top drive carriage (18) will also move downwards to screw the top drive sub (20) into the tubular. Then the stinger (17) will release its grip on the tubular and the top drive (19) and top drive carriage (18) will rise up to the top of the mast module (7) pulling the tubular onto the stinger (17), which, is also raised to its top position. The mechanism (22) will then return the whole mast assembly (7) to the centre line of the well bore and the top drive (19) cM then insert the tubular into the coupler within the top of the well head module (or the diverter module or the base module). The coupler will then effect the connection between the tubular and the string as described in any one of patent applications PCT/GB97/02815, PCT/GB99/03411 and PCT/GB01/04803. When a tubular is to be removed the process is reversed.

Referring to FIGS. 6 to 10 which show the sequence of constructing the well starting with the installation of the foundation conductor:

The conductor (2) is either driven in by the driving module (11), with the power module (4) attached and maintained in the required orientation by the ROT (10), or drilled in by the mast module (7) mounted on the base module (23) with the power module (4) and a pipe module (6) attached and maintained in the required orientation by the gimballed base (24) and the ROT (10).

Subsequently the base module (23) is mounted on the installed foundation conductor (2) and the mast module (7), mounted on the base module (23), drills and installs casings down to a diameter of 18¾". The power module (4), mud module (5) and pipe modules (6) are preferably attached to the base module (23).

Once the 18¾" casing is installed, the base module (23) is placed by the diverter module (12), which contains a large bore BOP (probably of 18¾" size) to contain any shallow gas or water that may be found during the initial drilling. The diverter module (12) transports fresh mud from the mud module (5) to the mast module (7) and the returning mud and cuttings back to the mud module (5). The diverter module (12) also transmits power and instrumentation and control signals between the surrounding modules and the drilling mast.

Once the 13⅜" casing is installed, the diverter module (12) is replaced by the wellhead module (3), which contains the smaller BOP stack (13) (probably 13⅝") and coupler (14). The switch from the diverter module (12) to the wellhead module (3) can take place at a larger diameter than 13⅜" if the particular field requires it, provided the internal diameter of the wellhead module (3) is increased.

Figures 6, 7, 8, 9, 10:
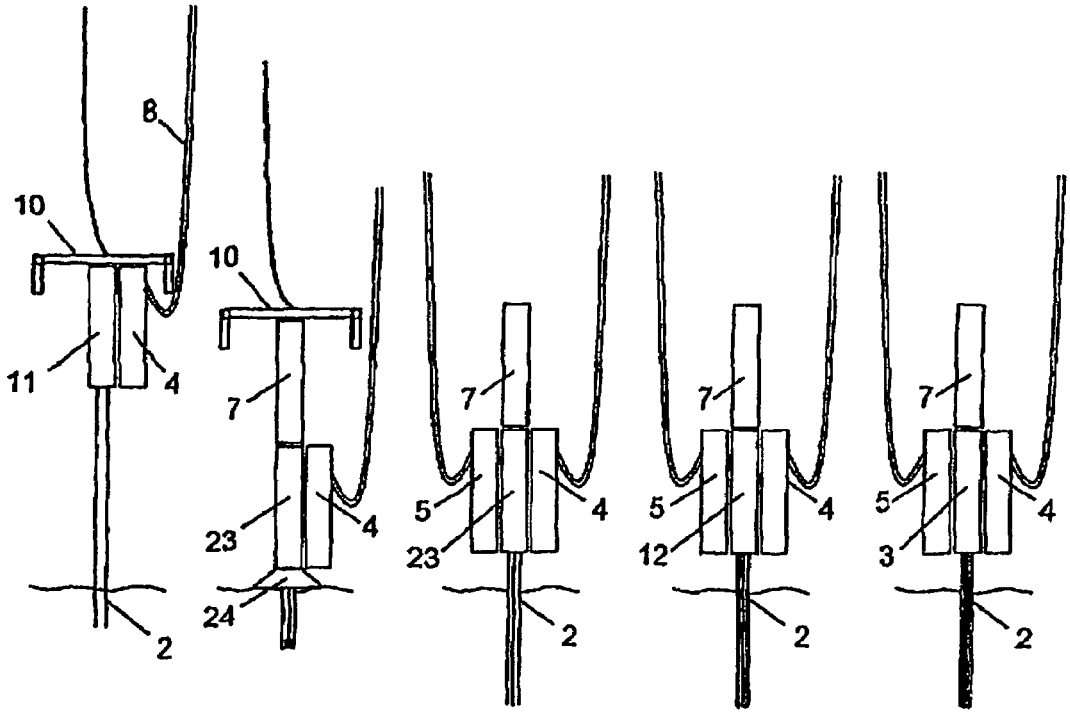
FIGS. 6 to 10 show the sequence of constructing the well

The assembly shown in FIG. 10 is capable of installing, testing and completing the well provided all of the tubular assemblies including downhole production assemblies are delivered to the seabed rig stored in the appropriately sectioned pipe modules (6).

The wellhead production tree, controls and flowline connections can all be flown to the wellhead and connected by the ROTs, monitored by ROVs and/or AUVs as is now state of the art in subsea production technology.

The invention claimed is:

1. A drilling rig for use underwater for rotating a drill string for drilling a bore hole in a seabed comprising:

(a) a storage system containing standard tubulars upright at multiple positions;

(b) a mast;

(c) means for moving said mast laterally;

(d) a stinger mounted on said mast of a size and shape for engaging and moving said tubulars out of said storage system and transporting said tubulars into a position vertically aligned with said drill string;

(e) rotary drive means connected to said stinger for rotating said stinger and each of said attached tubulars into threaded engagement with said drill string;

(f) continuous circulating coupler means attached to said drill string and each tubular for continuously circulating drilling fluid down said drill string during the connection and disconnection of each tubular to and from said drill string;

(g) carriage means mounted on said mast for vertically moving said stinger and each attached tubular into threaded engagement with said drill string; and means for moving said mast and said stinger laterally from the axis of said bore hole to multiple positions vertically above said tubulars in said storage system.

2. A drilling rig for use underwater for rotating a drill string for drilling a bore hole in a seabed comprising:

(a) a storage system for containing standard tubulars upright at multiple positions;

(b) a mast;

(c) means for moving said mast laterally;

(d) a stinger mounted on said mast of a size and shape for engaging and moving said tubulars out of said storage system and transporting said tubulars into a position vertically aligned with said drill string;

(e) rotary drive means connected to said stinger for rotating said stinger and each of said attached tubulars into threaded engagement with said drill string;

(f) continuous circulating coupler means attached to said drill string and each tubular for continuously circulating drilling fluid down said drill string during the connection and disconnection of each tubular to and from said drill string; and (g) a well head module, a mud module connected to said coupler, a power module, a base module, a driving module, and umbilical means connected to a vessel and to at least said power module and said mud module.

3. A drilling rig for use underwater for rotating a drill string for drilling a bore hole in a seabed comprising:

(a) a storage system for containing standard tubulars upright at multiple positions;

(b) a mast;

(c) means for moving said mast laterally;

(d) a stinger mounted on said mast of a size and shape for engaging and moving said tubulars out of said storage system and transporting said tubulars into a position vertically aligned with said drill string;

(e) rotary drive means connected to said stinger for rotating said stinger and each of said attached tubulars into threaded engagement with said drill string;

(f) continuous circulating coupler means attached to said drill string and each tubular for continuously circulating drilling fluid down said drill string during the connection and disconnection of each tubular to and from said drill string;

(g) carriage means mounted on said mast for vertically moving said stinger and each attached tubular into threaded engagement with said drill string; and (h) wherein said coupler means includes a fluid-tight housing, movable divider means for dividing said housing into upper and lower chambers, seal means for sealing said housing about said drill string and each of said tubulars as each of said tubular are threadedly connected to said drill string, and umbilical means for continuously supplying drilling fluid down said drill string while each tubular is connected to or removed from said drill string.

4. A drilling rig for use underwater for rotating a drill string for drilling a bore hole in a seabed comprising:

(a) a storage system for containing standard tubulars upright at multiple positions;

(b) a mast;

(c) means for moving said mast laterally between a position above said storage system and a position above said drill string;

(d) a stinger mounted on said mast of a size and shape for engaging and moving said tubulars out of said storage system and transporting said tubulars into a position vertically aligned with said drill string;

(e) rotary drive means connected to said stinger for rotating said stinger and each of said attached tubulars into threaded engagement with said drill string; and (f) continuous circulating coupler means attached to said drill string and each tubular for continuously circulating drilling fluid down said drill string during the connection and disconnection of each tubular to and from said drill string.

5. The drilling rig of claim 4 including carriage means mounted on said mast for vertically moving said stinger and each attached tubular into threaded engagement with said drill string.

6. The drilling rig of claim 4 wherein said storage system comprises a standard ISO container including means dividing said ISO container into individual compartments for each individual tubular and positioned with the axes of the contained tubulars in vertical positions.

7. A modular underwater drilling rig for drilling hydrocarbons under the sea comprising:

(a) a wellhead module;

(b) a power module operatively connected to said wellhead module;

(c) a mud module operatively connected to said wellhead module;

(d) at least one tubular module containing a plurality of tubulars;

(e) a laterally movable mast;

(f) means for moving said mast laterally over said at least one tubular module; and (g) means carried by said mast for removing individual tubular from said tubulars module and connecting said individual tubulars to other tubulars to form a drill string extending below the seabed.

8. The modular underwater drilling rig of claim 7 including:

(a) at least one umbilical extending from said power module to the surface of the sea: and (b) at least one umbilical extending from said mud module to the surface of the sea.

* * * * *

UNITED STATES PATENT AND TRADEMARK OFFICE

CERTIFICATE OF CORRECTION

PATENT NO. : 7,584,796 B2
APPLICATION NO. : 11/654343
DATED : September 8, 2009
INVENTOR(S) : Laurence John Ayling It is certified that error appears in the above-identified patent and that said Letters Patent is hereby corrected as shown below:

On the Title Pg. add

Related U.S. Application Data

Item (63) Continuation of 10/513,080, filed as application number PCT/GB03/01828 on April 29, 2003

(30) Foreign Application Priority Data

April 29, 2003 (GB) 0209861.4

Signed and Sealed this
First Day of May, 2012

David J. Kappos

David J. Kappos
*Director of the United States Patent and Trademark Office*